US006389765B1

(12) United States Patent
Hautala

(10) Patent No.: US 6,389,765 B1
(45) Date of Patent: May 21, 2002

(54) CORNER JOINT

(75) Inventor: Jouko Hautala, Tampere (FI)

(73) Assignee: Red Wire Oy, Tampere (FI)

( * ) Notice: Subject to any disclaimer, the term of this patent is extended or adjusted under 35 U.S.C. 154(b) by 0 days.

(21) Appl. No.: 09/647,359

(22) PCT Filed: Apr. 1, 1999

(86) PCT No.: PCT/FI99/00274

§ 371 Date: Sep. 29, 2000

§ 102(e) Date: Sep. 29, 2000

(87) PCT Pub. No.: WO99/53153

PCT Pub. Date: Oct. 21, 1999

(30) Foreign Application Priority Data

Apr. 1, 1998 (FI) ..... 980739

(51) Int. Cl.[7] ..... E04B 1/10

(52) U.S. Cl. ..... 52/233; 52/275; 52/656.1; 403/218; 403/346

(58) Field of Search ..... 52/233, 275, 656.1; 403/217, 218, 219, 346, 400

(56) References Cited

U.S. PATENT DOCUMENTS

| | | | | | |
|---|---|---|---|---|---|
| 3,304,674 | A | * | 2/1967 | Ward | 52/233 |
| 3,381,428 | A | * | 5/1968 | Sillman | 52/233 |
| 4,034,527 | A | * | 7/1977 | Jalasjaa | 52/233 |
| 4,056,906 | A | | 11/1977 | Elfstrom | |
| 4,096,674 | A | * | 6/1978 | Kollar et al. | 52/233 |
| 4,320,610 | A | * | 3/1982 | Rupp | 52/233 |
| 4,330,973 | A | * | 5/1982 | Marklund et al. | 52/233 |
| 4,503,647 | A | | 3/1985 | Post | |
| 4,592,182 | A | * | 6/1986 | Felser | 52/233 |
| 4,619,089 | A | * | 10/1986 | Stein | 52/233 |
| 4,640,069 | A | * | 2/1987 | Felser | 52/233 |
| 4,967,526 | A | | 11/1990 | Yost | |
| 5,010,701 | A | * | 4/1991 | Halsey, Jr. et al. | 52/233 |
| 5,072,559 | A | * | 12/1991 | Liljegren | 52/233 |
| 5,430,983 | A | * | 7/1995 | Taipalensuu | 52/233 |
| 5,577,357 | A | * | 11/1996 | Civelli | 52/233 |

FOREIGN PATENT DOCUMENTS

| | | |
|---|---|---|
| CH | 433 657 | 9/1967 |
| DE | 186837 | 6/1906 |
| WO | WO 91/08359 | 6/1991 |

* cited by examiner

*Primary Examiner*—Carl D. Friedman
*Assistant Examiner*—Phi Dieu Tran A
(74) *Attorney, Agent, or Firm*—Larson & Taylor PLC

(57) ABSTRACT

A corner joint for a building made of timber elements. The exterior surface of the building is a wall element made of logs, and the interior surface is a wall element is also made of logs. The space between the wall elements is fitted with thermal insulation. Both wall elements end inside the corner joint, so that the exterior corner, which extends over the wall line of the building is made of separate corner elements on top of one another. The interior wall elements are placed crosswise in the corner, reach to and end substantially in the exterior wall elements. The crosswise stacked corner elements have extensions, which between the interior and exterior wall elements, reach over the crosswise interior wall elements. The extensions have an inter-locking shape, such as a notch, at the interior wall elements.

11 Claims, 4 Drawing Sheets

CORNER JOINT

FIELD OF THE INVENTION

The invention relates to a corner joint, which is used by a framework. The corner joint is especially suited for a wall construction built of an exterior wall element, an inner wall element and thermal insulation between them.

BACKGROUND OF THE INVENTION

Corner joint solutions by building framework elements are previously known among other things from the Finnish publication print 94276 and application prints 222/68, 864707, 950847 and 94276. In said solutions, there are interior wall and exterior wall elements. The wall elements extend over the corner, or at least one of them. If both wall elements extend over the corner, on the outside a double corner will be visible (94276) or a corner made massive by means of extra bits between the elements (864707 and 222/68). If only one of the two wall elements extends over the corner, the corner extension will be narrow (950847, 960737) with a thickness remarkably thinner than the wall, such as 50% of the wall thickness only.

In the above presented solutions the corner piece does not look outwards like a massive log as thick as the wall. It is made as thick as the wall either by joining parallel elements together or it is formed of one log but with a thickness less than half of the wall thickness.

SUMMARY OF THE INVENTION

By means of a corner joint as per this invention the above problem is solved. The invention is characterized (a) in that the elements forming the interior wall in the corner are placed crosswise and reach, substantially, to and end at the elements that form the exterior wall, and (b) in that the crosswise stacked corner elements have extensions, which in the space between corner elements extend over the intersecting interior wall elements and said extensions have an interlocking shape, such as a notch at the interior wall elements.

Other features characteristic of the invention are presented hereafter.

The advantage of the corner joint of this invention is (a) that by means of it the interior wall and exterior wall elements can be interlocked at a distance from one another, and (b) that the corner is in horizontal plane directions secured in a manner so that it cannot be unlocked and so that the external elements will stay in position, the interior wall will not move either inward or outward and neither can the corner elements move in the horizontal plane. The log portion then forming the exterior corner element can be, for instance, as thick as the wall or as thick as preferred.

BRIEF DESCRIPTION OF THE DRAWING

In the following the invention is disclosed with reference to the enclosed drawing, where.

DETAILED DESCRIPTION OF THE INVENTION

Figure 1C:
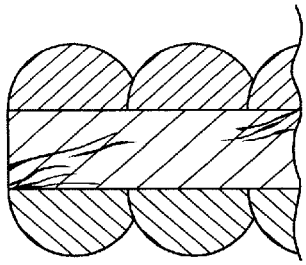
FIG. 1*c* is a cross-sectional view taken along section line C—C in FIG. 1*b;*
Figure 1B:
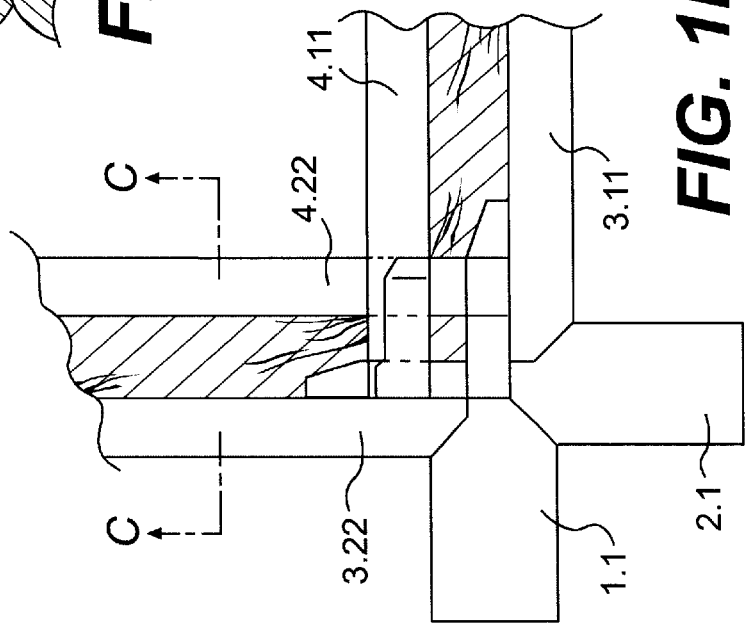
FIG. 1*b* shows a corner joint from above and made of round log elements.
Figure 1A:
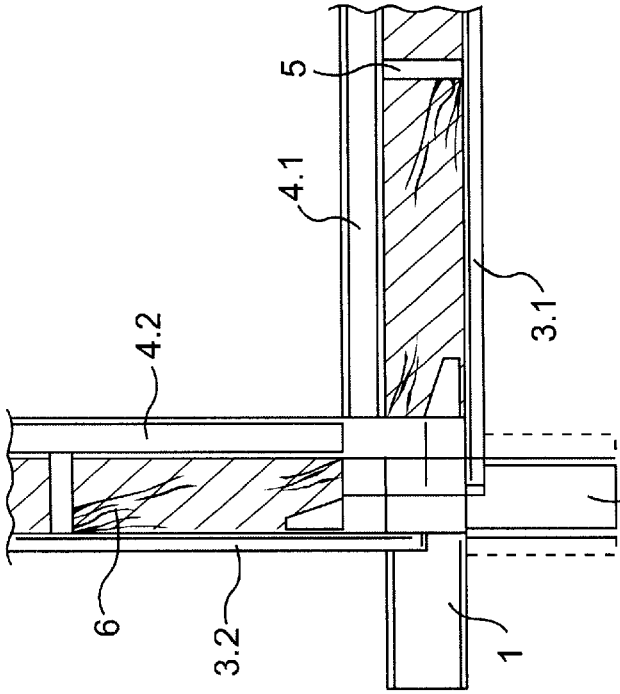
FIG. 1*a* shows a corner joint from above.

FIG. 1*a* shows the corner joint of a log house from above, where the elements forming the interior wall, such as logs, are marked 4.1 and 4.2 and the elements forming the exterior wall elements, such as logs, are marked 3.1 and 3.2. There is heat insulation 6 between the wall elements. Further away on the wall there is a spacing piece 5 keeping the wall elements at proper distance. The proximal ends of no wall element will be visible from the outside, as the proximal ends of the wall elements end in side the corner joint. Separate exterior corner elements 1 and 2 are fitted in and stacked one upon another between the wall elements and will form a visible corner. Accordingly, the appearance of the corner joint is produced only by choosing a suiting massive log, out of which the corner elements 1 and 2 are cut off and shaped. The broken lines illustrate how the exterior free top end of the corner element can be configured as to its thickness according to how massive an appearance is wanted.

The corner elements 1 and 2 extend inside the wall at least slightly over the respective interior wall element 4.2 and 4.1 in order to produce interlocking by means of a notch system. Further, the exterior wall elements 3.2 and 3.1 reach with equal proximal ends and without interlocking into a vertical notch formed inside respective corner elements 1 and 2.

In FIG. 1*b* a corresponding corner joint is illustrated in a round log structure as shown by FIG. 1*c*.

The exterior wall elements 3.11 and 3.22 are also cut off with equal proximal ends, for instance, with 45° bevels added to them. Shaping the interior wall element proximal ends is somewhat more demanding compared with the FIG. 1*a* structure. Likewise, the corner elements 1.1 and 2.2 have 45° bevels.

Figure 2B:
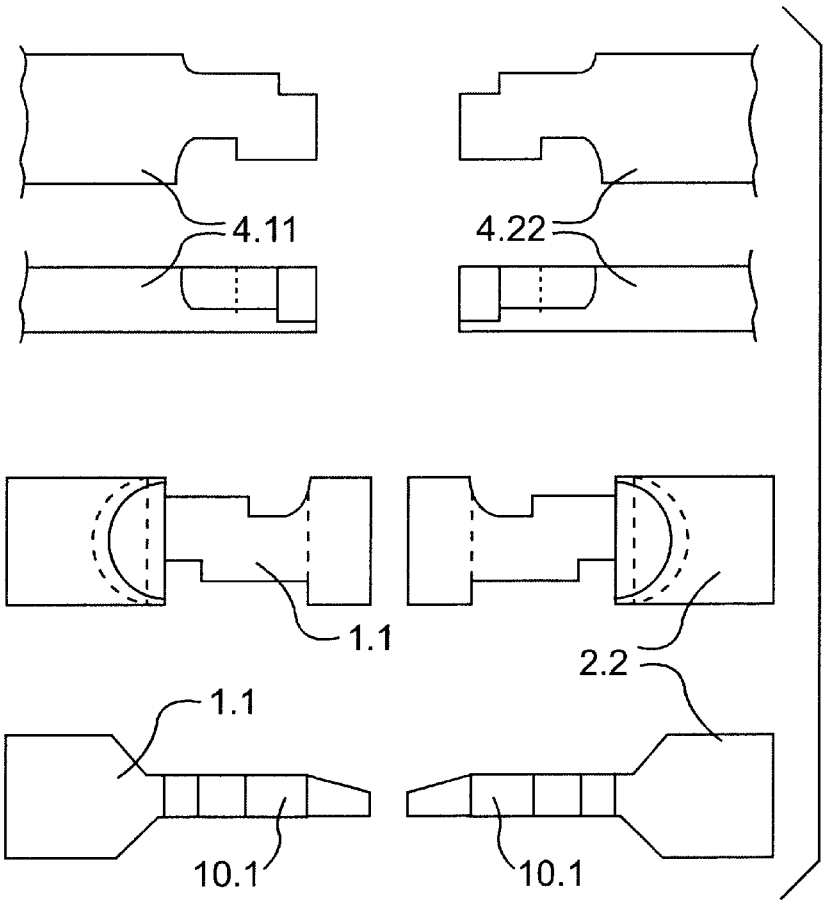
FIG. 2*b* shows the interior wall element top ends and corner elements made of round log elements.
Figure 2A:
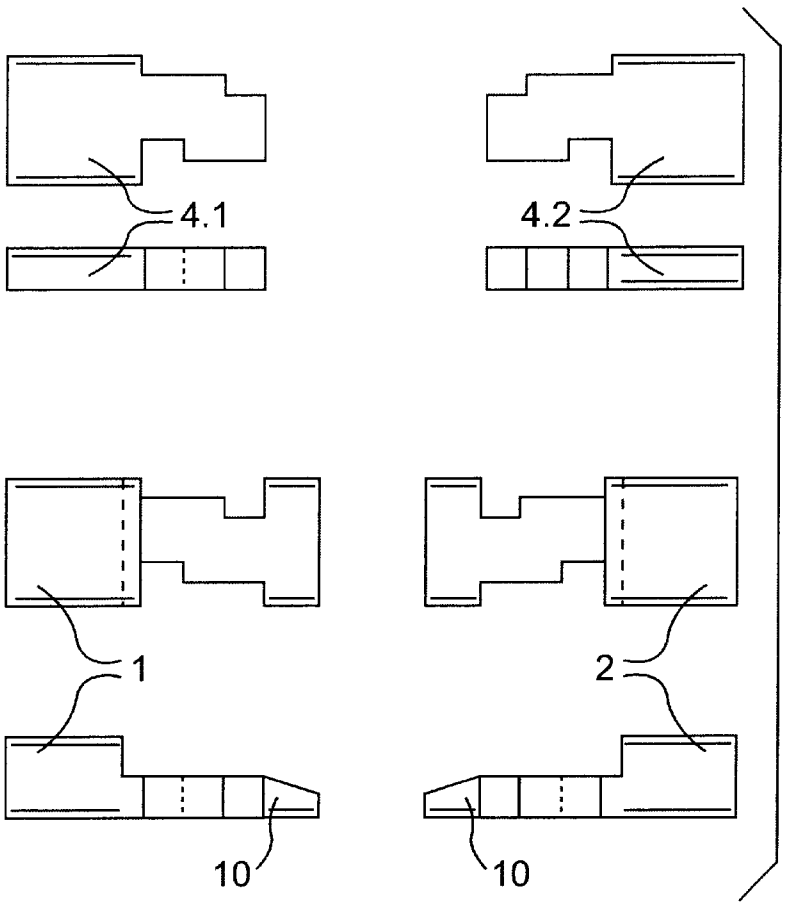
FIG. 2*a* shows the interior wall element top ends and corner elements.

FIGS. 2*a* and 2*b* include some feasible solution alternatives for the proximal ends of interior wall elements 4.1, 4.2 and 4.11, 4.22. In the figures also constructional changes of corner elements 1, 2 and 1.1, 1.2 with different interlocking notches in extension portions 10 and 10.1 of the elements are shown. Interlocking notches in the extension portion are needed both for the other crosswise corner element and the crosswise interior wall element. The extensions have interlocking notches, on their upper and bottom surface. The extension portions 10 and 10.1 of the corner elements are much thinner than the visible portion on the outside.

Figure 3:
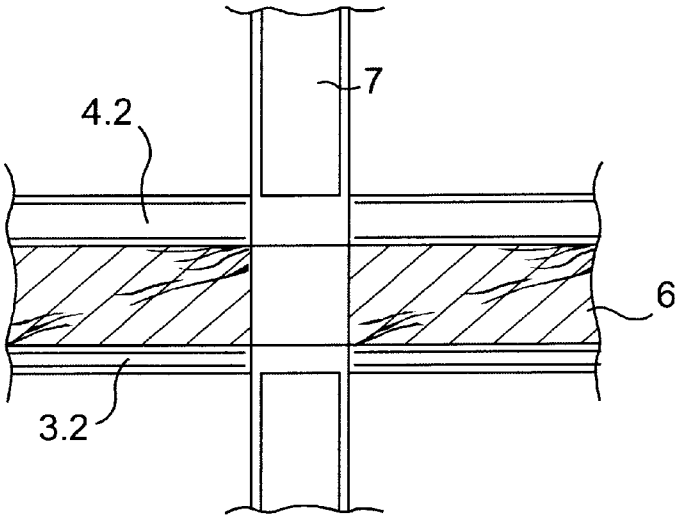
FIG. 3 shows the crossing of interior wall and exterior wall.

FIG. 3 shows a partition wall 7, which in a conventional framework structure can be taken through the exterior wall, e.g. with both proximal ends half-notched.

Figure 4:
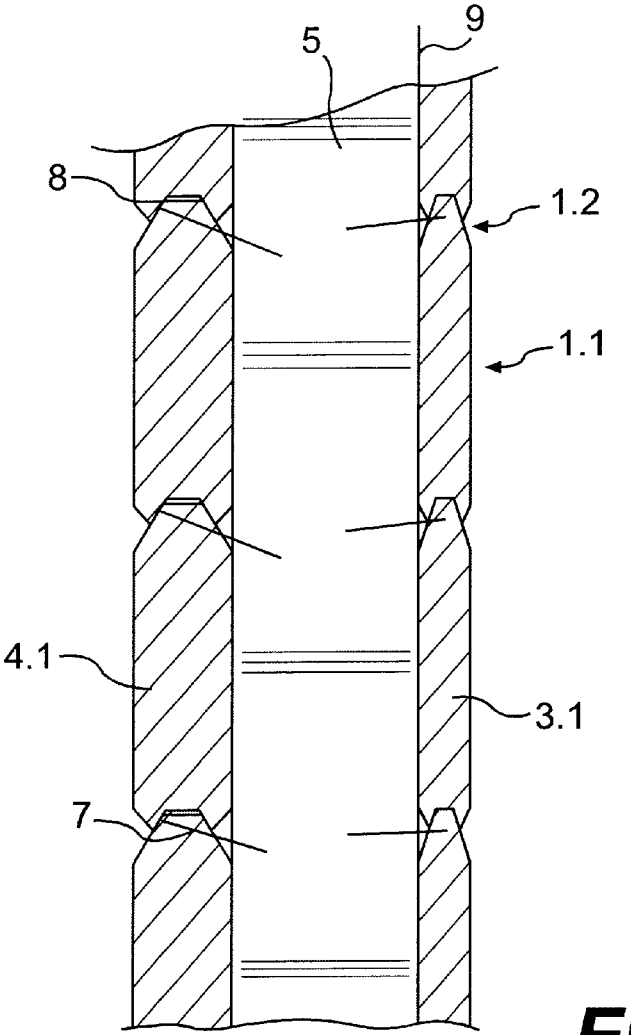
FIG. 4 shows the cross-section of a wall.

FIG. 4 is a cross-section of the wall 7. The interior wall elements 4.1 are substantially thicker than the exterior elements 3.1. In the wall portions, distance-adjusting pieces 5 are used and the elements can be fastened by nailing diagonally or secured with screws to them. Pieces 5 are advantageously broken-off from the interior or exterior wall elements and mounted so that their joint 11 is in the middle of the wall element joint 12. Thus sliding of pieces 5 crosswise in the wall direction is prevented and straightness of wall retained. To ensure tightness, in the joint between interior wall elements, insulation 8 is used; and cardboard or lining paper is used on the inner surface of the logs. Thermal insulation 5 is advantageously made of woodfibre blasting wool. The interior and exterior wall elements are of similar height and simultaneously mounted in layers.

Figure 5:
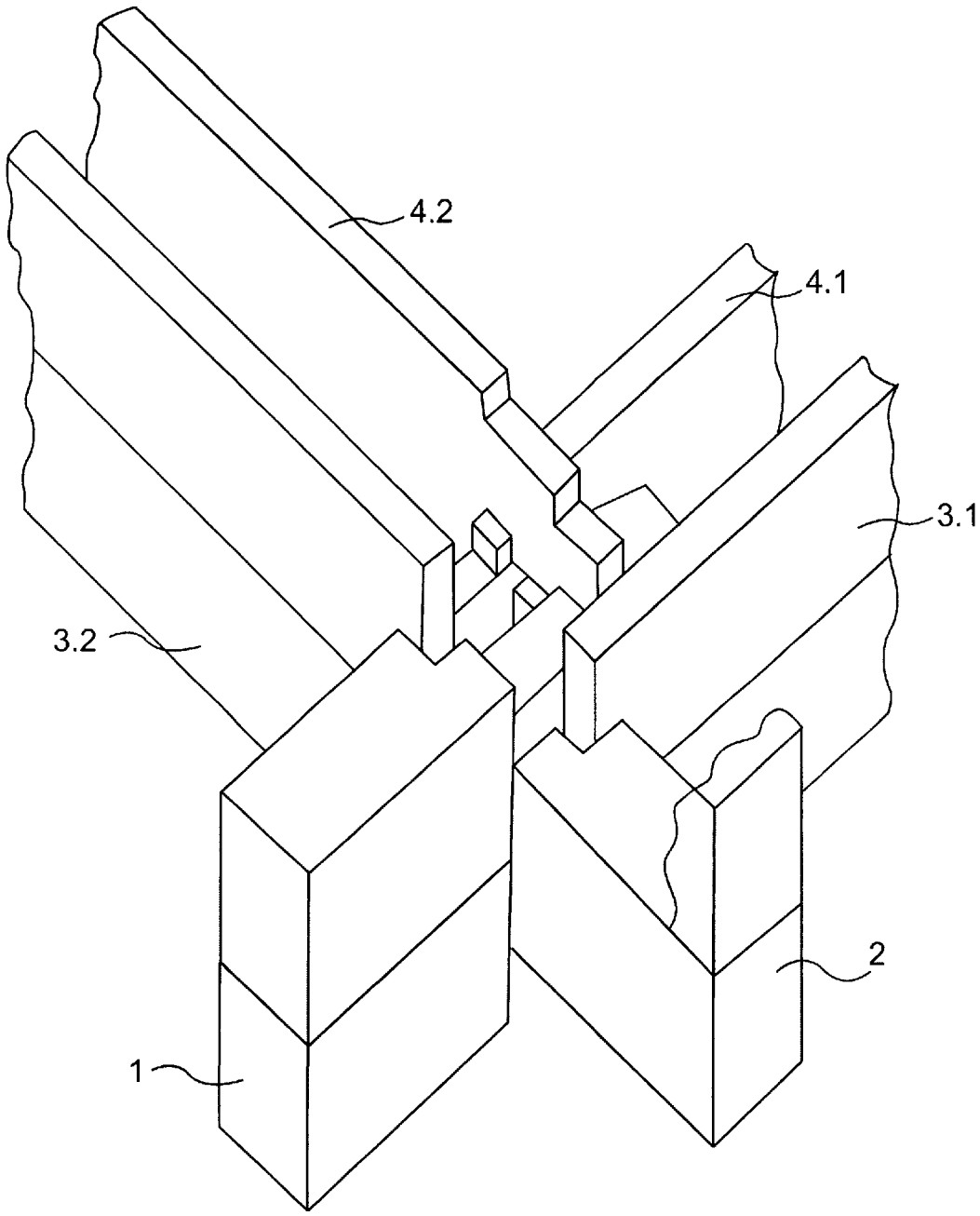
FIG. 5 shows a corner joint diagonally viewed from above.

FIG. 5 shows a corner joint as per the invention diagonally viewed from above. Each corner element 1 and 2 has notches in its extension, by means of which the extension interlocks the other crosswise corner element and the interior wall element so that they cannot move in the direction of the interlocking extension. Shaping of wall element proximal ends is easily done mechanically as well as shaping of the corner elements.

The exterior wall element is most conveniently thinner than the interior wall element. The exterior wall element is exposed to thermal fluctuations and its massiveness is hardly of any use. The aim is to maintain constant temperature in the interior wall, i.e. inside the insulation layer, and its massiveness, produced among other things by thickness, makes it better.

When the corner element extensions are thinner than the thickness of the insulation layer and the interior wall elements on top of the other are not in contact with each other in the insulation space but there is a gap between them, the insulation space thus extends through the corner joint. Therefore, when blasting wool is used, the blasting wool can fill all empty spaces in the corner.

What is claimed is:

1. A corner joint for a building made of timber elements comprising:

first and second crosswise walls of the building, said first and second walls including first and second interior wall constructions which are made of respective first and second horizontally extending interior wall elements, first and second exterior wall constructions which are made of respective first and second horizontally extending exterior wall elements, said first and second exterior wall constructions laterally facing respective said first and second interior wall constructions to define first and second spaces therebetween, a thermal insulation fitted in said first and second spaces, first and second proximal ends of respective said first and-second interior wall elements which are arranged crosswise and which extend,substantially to respective said second and first exterior wall constructions, first and second proximal ends of respective said first and second exterior wall elements which terminate prior to an intersection with a plane of the respective said second and first exterior wall constructions; and first and second crosswise corner elements stacked one on top of another to form a viewable exterior corner, said first and second corner elements including first and second bases which exteriorly cover respective said proximal ends of said second and first exterior wall elements, and first and second extensions extending from respective said first and second bases towards respective said first and second spaces, said first and second extensions having respective shapes which interlock with respective said second and first proximal ends of said interior wall elements in respective said second and first spaces.

2. A corner joint as claimed in claim 1:

wherein respective said first and second extensions have a horizontal width which is substantially smaller than a horizontal width of the respective said first and second bases and which is substantially smaller than a respective horizontal width of said first and second spaces; and wherein said shapes of respective said first and second extensions include a respective notch interlocking respective said second and first proximal ends of said interior wall elements.

3. A corner joint as claimed in claim 1, wherein each respective intersection of said first and second bases with respective said first and second extensions is a respective first and second notch in which said second and first proximal ends of said second and first exterior wall elements are received.

4. A corner joint as claimed in claim 1:

wherein respective said first and second proximal ends of said first and second exterior wall elements are laterally trapped between respective said second and first bases and respective said first and second extensions; and wherein respective said first and second proximal ends of said first and second interior wall elements are laterally trapped in a respective first and second notches provided in respective said second and first extension, said notches being located away from respective said first and second bases by a distance which maintains said second and first spaces.

5. A corner joint as claimed in claim 1, wherein said first and second bases have a lateral dimension which is larger than a maximum thickness of respective said first and second exterior wall elements.

6. A corner joint as claimed in claim 1, wherein respective said first and second proximal ends of said first and second exterior wall elements longitudinally terminate after passing respective said second and first bases but prior to an abutment with respective said second and first extensions.

7. A corner joint as claimed in claim 1, wherein a maximum thickness of respective said first and second interior wall elements is greater than a maximum thickness of respective said first and second exterior wall elements.

8. A corner joint as claimed in claim 1:

wherein corner spaces are provided between respective said first and second extensions and respective said first and second interior wall elements; and wherein a thermal insulation is also provided in said corner spaces.

9. A corner joint as claimed in claim 2, wherein each respective intersection of said first and second bases with respective said first and second extensions is a respective first and second notch in which said second and first proximal ends of said second and first exterior wall elements are received.

10. A corner joint as claimed in claim 3:

wherein respective said first and second proximal ends of said first and second exterior wall elements are laterally trapped between respective said second and first bases and respective said first and second extensions; and wherein respective said first and second proximal ends of said first and second interior wall elements are laterally trapped in respective first and second notches provided in respective said second and first extensions, said first and second notches being located away from respective said first and second bases by a distance which maintains said second and first spaces.

11. A corner joint as claimed in claim 10, wherein respective said first and second proximal ends of said first and second exterior wall elements longitudinally terminate after passing respective said second and first bases but prior to an abutment with respective said second and first extensions.

* * * * *